US011084699B2

(12) United States Patent
Kawell et al.

(10) Patent No.: US 11,084,699 B2
(45) Date of Patent: Aug. 10, 2021

(54) PRY BAR ATTACHMENT HAVING ADJUSTABLE FULCRUM

(71) Applicant: Robert Bosch GmbH, Stuttgart (DE)

(72) Inventors: Mike Kawell, Granite Falls, NC (US); Robert Jensen, Clark's Grove, MN (US); Dirk Skogerboe, Faribault, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 231 days.

(21) Appl. No.: 16/369,984

(22) Filed: Mar. 29, 2019

(65) Prior Publication Data

US 2020/0307979 A1 Oct. 1, 2020

(51) Int. Cl.
*B66F 15/00* (2006.01)

(52) U.S. Cl.
CPC ..... *B66F 15/00* (2013.01)

(58) Field of Classification Search
CPC ..... B66F 15/00; B66F 5/00; B66F 2700/00; B66F 2700/025
See application file for complete search history.

(56) References Cited

U.S. PATENT DOCUMENTS

| | | | | |
|---|---|---|---|---|
| 9,624,082 | B1 * | 4/2017 | Provines | B25C 11/00 |
| 2008/0164446 | A1 * | 7/2008 | Baldwin | E04H 17/265 254/30 |
| 2012/0074362 | A1 * | 3/2012 | Sanchez | E04H 17/265 254/30 |
| 2020/0307979 | A1 * | 10/2020 | Kawell | B66F 15/00 |

* cited by examiner

*Primary Examiner* — Lee D Wilson
(74) *Attorney, Agent, or Firm* — David Kovacek; Maginot, Moore & Beck LLP

(57) ABSTRACT

A pry bar attachment operable to receive to a pry bar to provide a fulcrum point during use of the associated pry bar. The pry bar attachment may comprise a fulcrum coupled to a sleeve, the sleeve operable to receive a pry bar. The pry bar attachment may be an adjustable pry bar attachment having one or more adjustable features, such as fulcrum height, sleeve dimensions, or friction adjustment.

9 Claims, 10 Drawing Sheets

PRY BAR ATTACHMENT HAVING ADJUSTABLE FULCRUM

TECHNICAL FIELD

This disclosure relates to hand tools, and in particular an attachment for a pry bar.

BACKGROUND

The leverage of a pry bar may be directed or enhanced using an additional fulcrum. Use of an additional fulcrum may protect the surface providing leverage for the pry bar, and may also improve the user's ability to control the application of leverage.

However, in practice an additional fulcrum may be ill-suited for use in a variety of tasks, and often the additional fulcrum may be improvised from readily-available materials (such as a block of scrap wood). Improvised fulcrums may suffer from degradation with use, poor versatility, or poor stability on irregular surfaces. What is desired is a fulcrum that functions well in a variety of applications, including stability on irregular surfaces.

SUMMARY

One aspect of this disclosure is directed to an adjustable pry bar attachment comprising a sleeve operable to receive a pry bar. The sleeve may be operably coupled to a fulcrum used as a focus point of the force applied to the pry bar during use. One or more elastic elements may provide friction forces to the pry bar when received by the sleeve, the friction forces being sufficient to prevent motion of the sleeve along the longitudinal length of a received pry bar during application of force. Fulcrum may comprise a concave mounting surface, suitable to provide a stable mounting of the pry bar attachment on an irregular surface.

In some embodiments, the sleeve may comprise a first upright member, a second upright member, and a spine member disposed between the first upright member and the second upright member.

The above aspects of this disclosure and other aspects will be explained in greater detail below with reference to the attached drawings.

BRIEF DESCRIPTION OF THE DRAWINGS

FIG. 2I is a top view of an adjustable pry bar attachment.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1A:
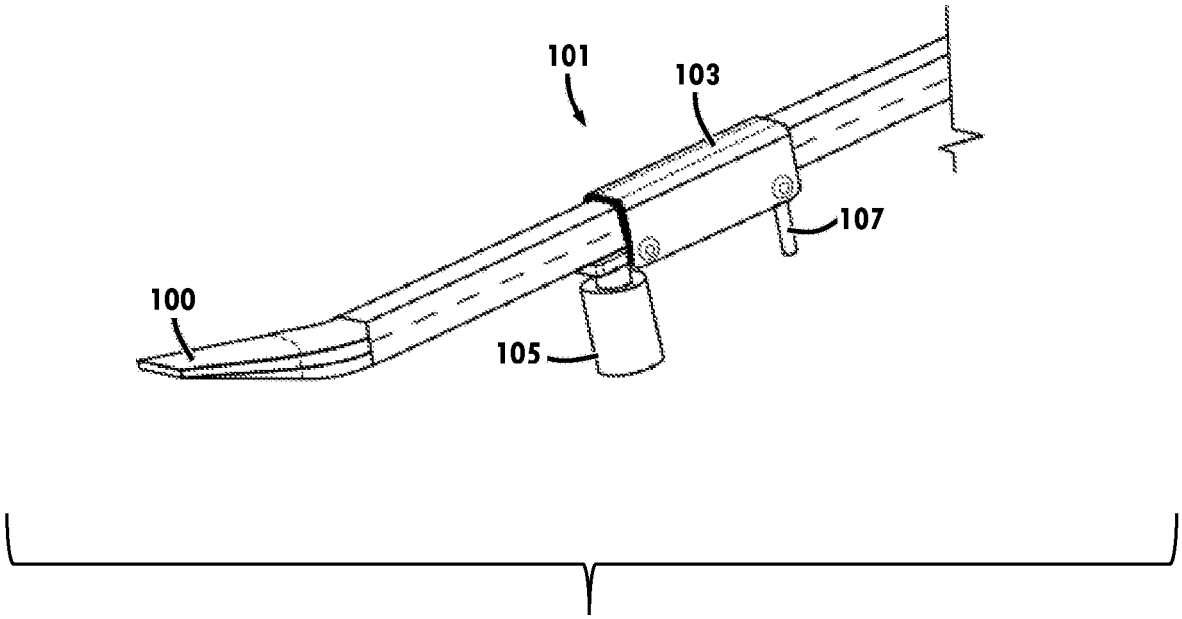
FIG. 1A is an isometric view of an adjustable pry bar attachment having received a pry bar.
Figure 1B:
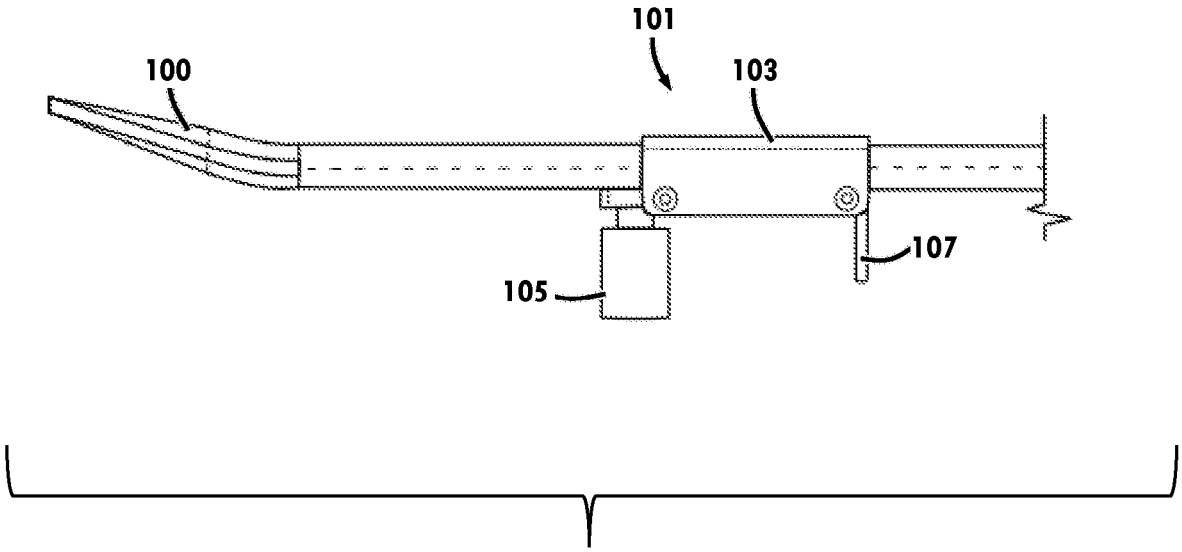
FIG. 1B is a side view of an adjustable pry bar attachment having received a pry bar.
Figure 2A:
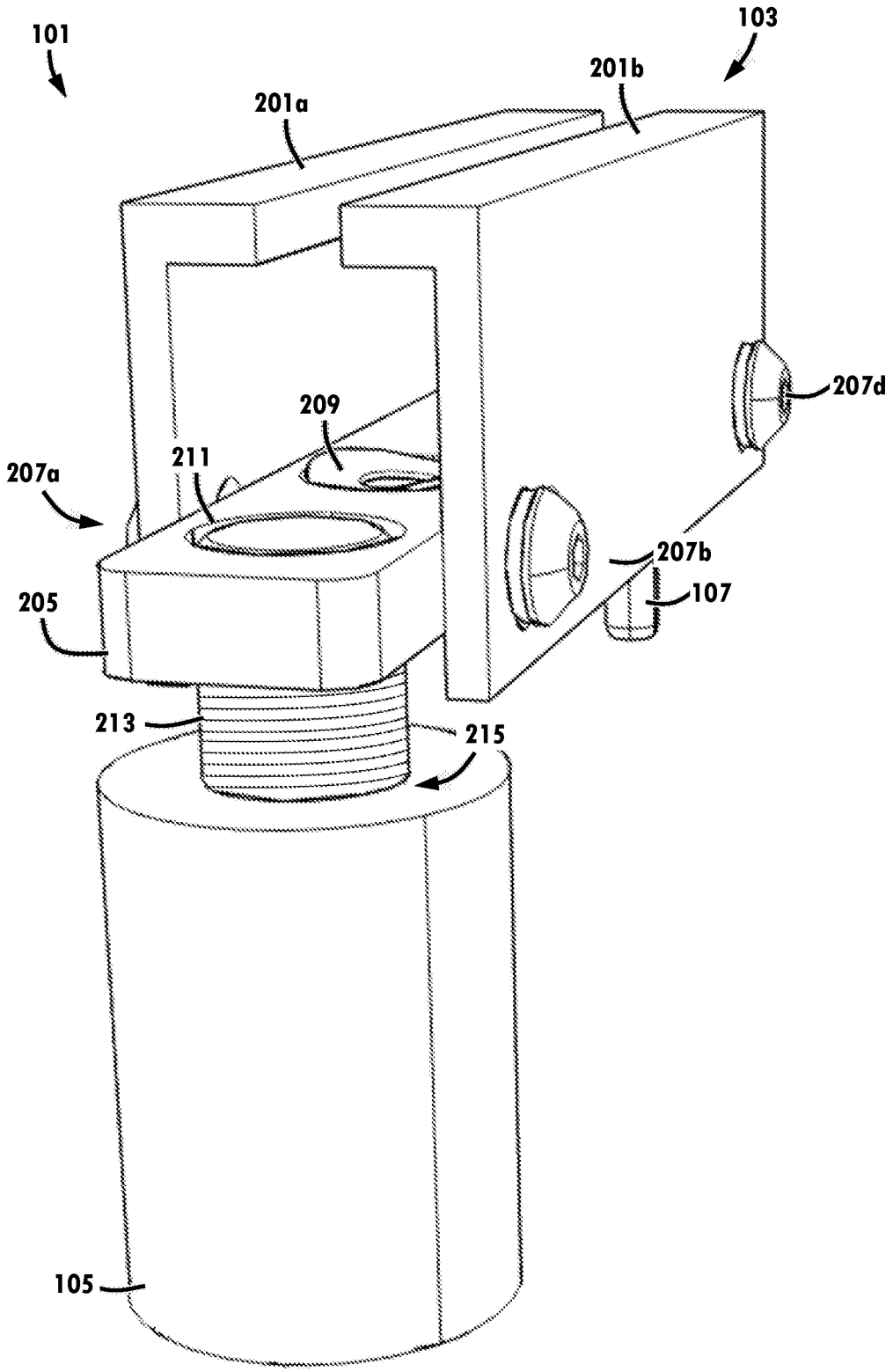
FIG. 2A is a first isometric view of an adjustable pry bar attachment.
Figure 2B:
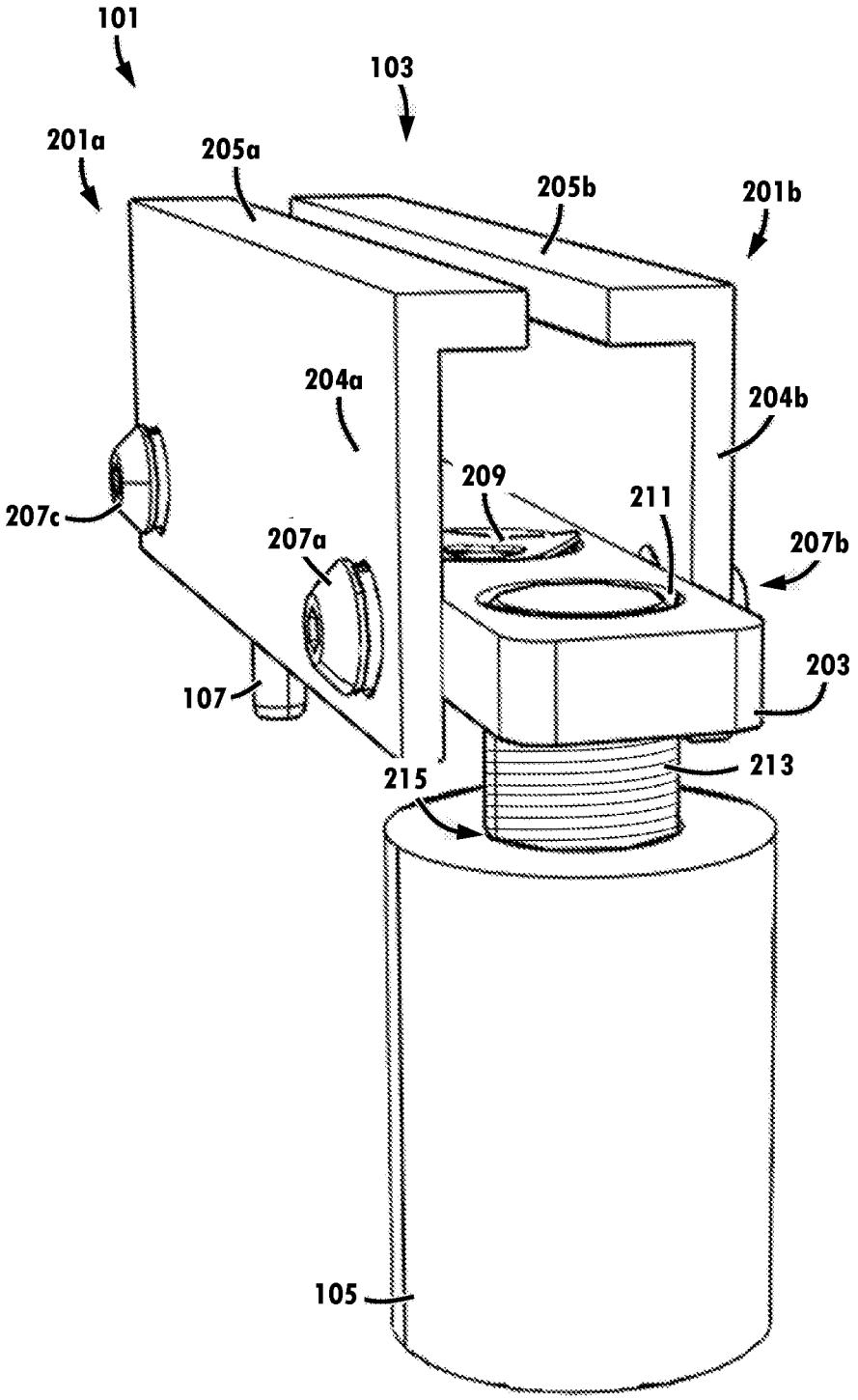
FIG. 2B is a second isometric view of an adjustable pry bar attachment.
Figure 2C:
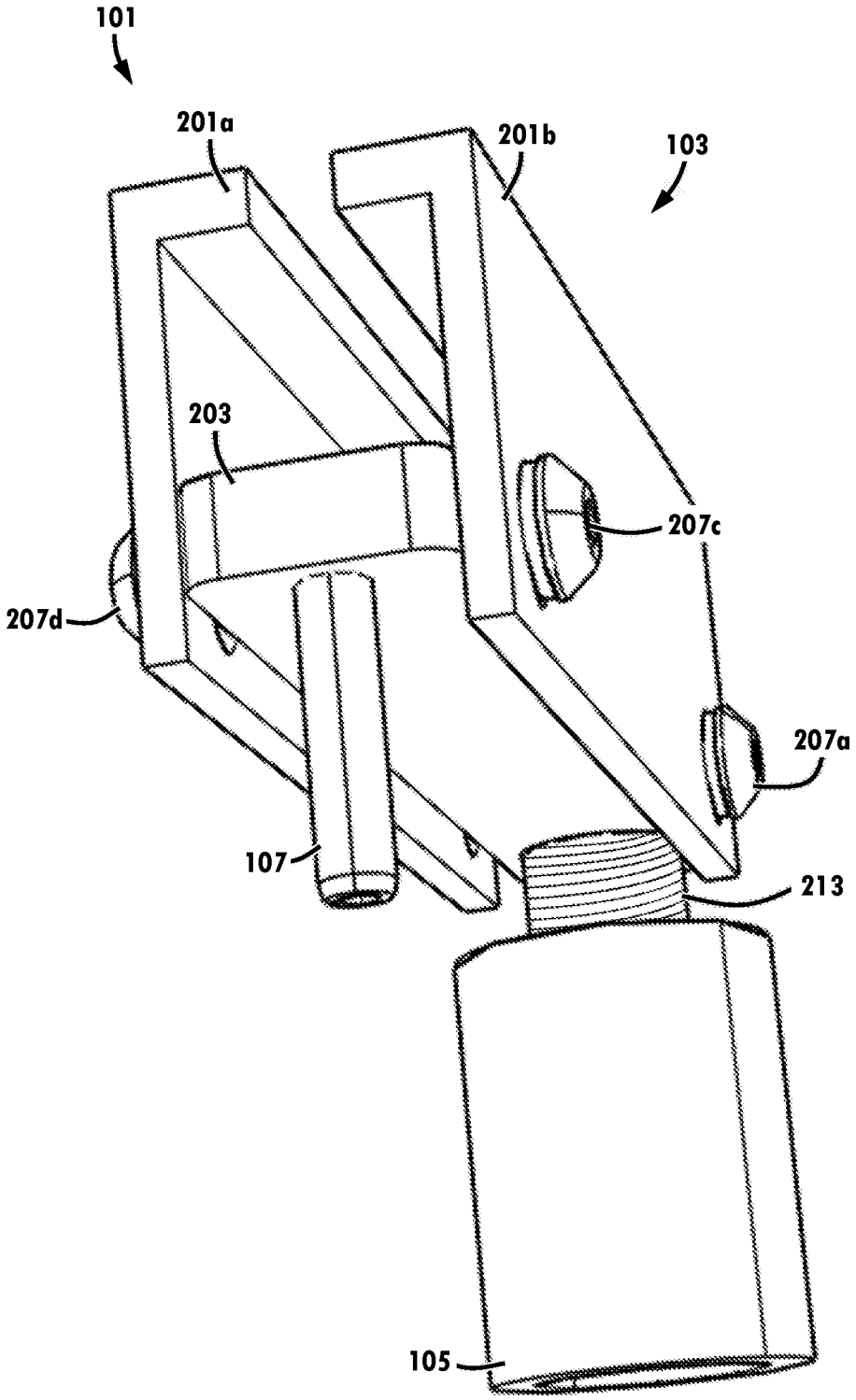
FIG. 2C is a third isometric view of an adjustable pry bar attachment.
Figure 2D:
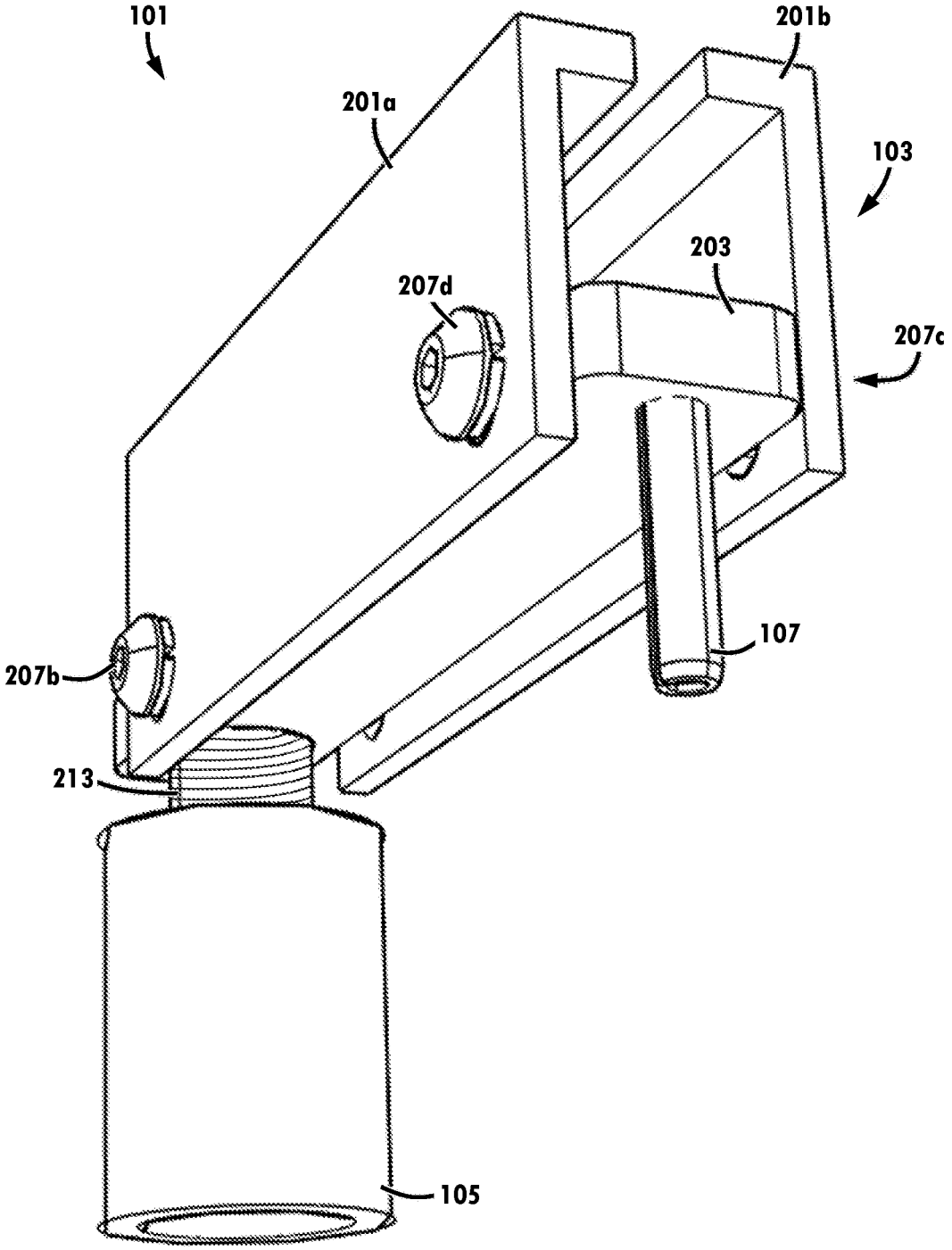
FIG. 2D is a fourth isometric view of an adjustable pry bar attachment.
Figure 2E:
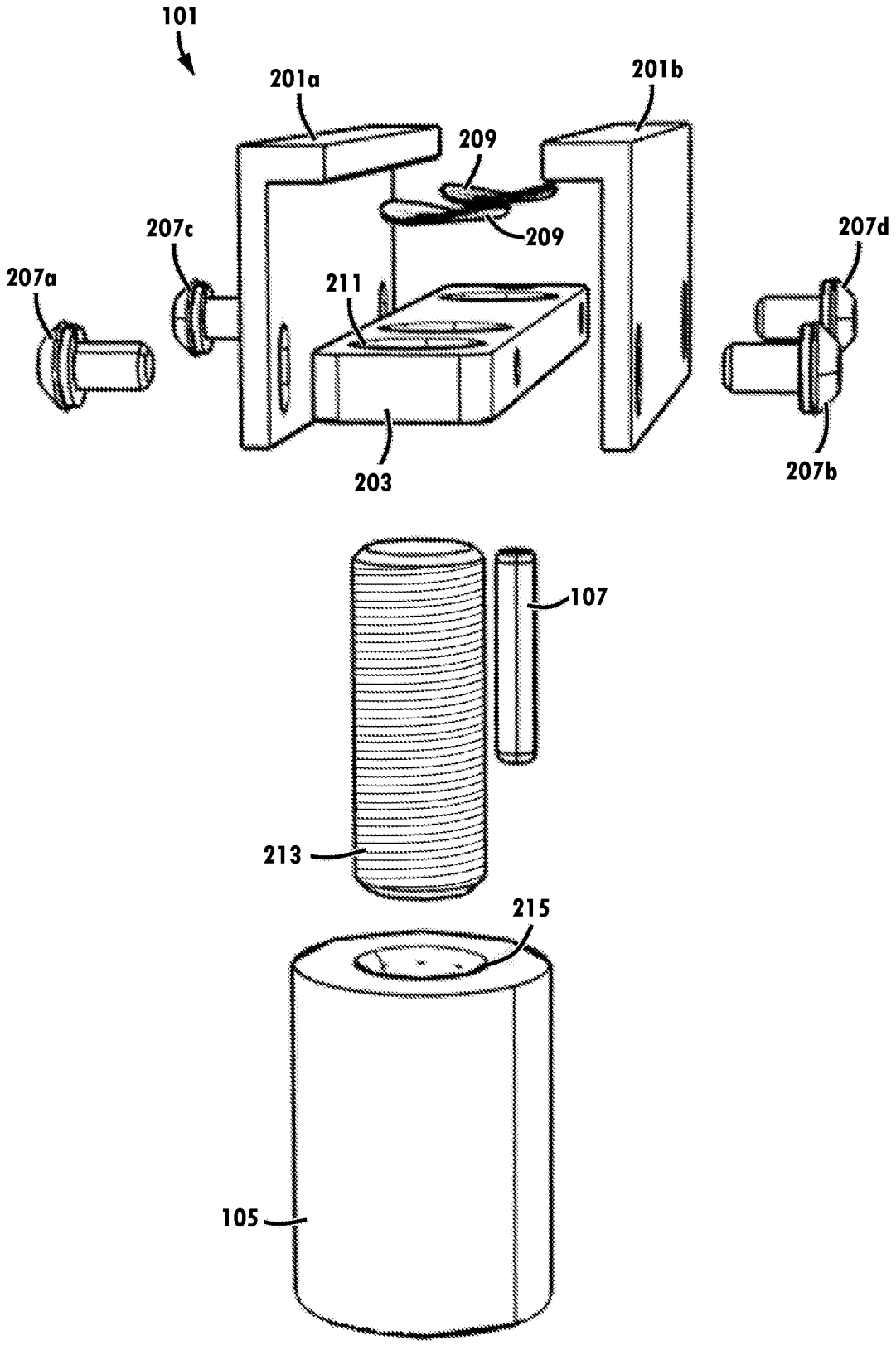
FIG. 2E is an exploded view of an adjustable pry bar attachment.
Figure 2F:
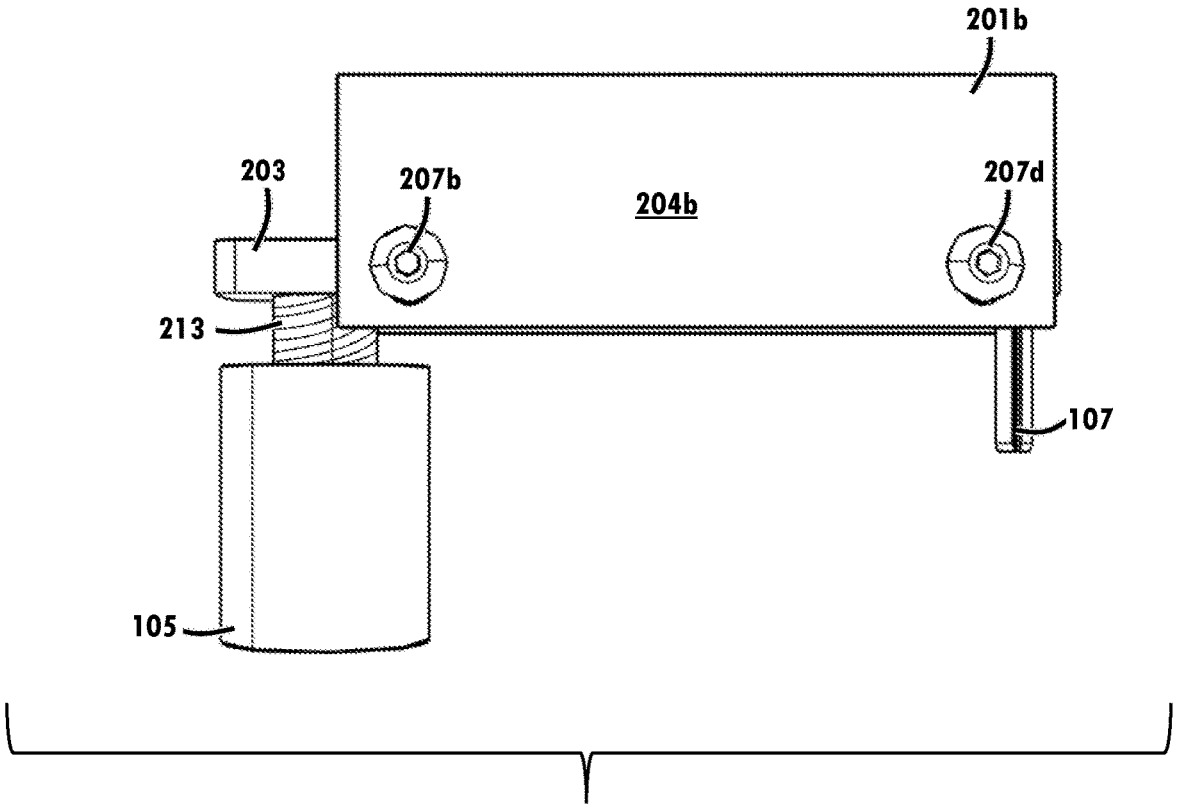
FIG. 2F is a first side view of an adjustable pry bar attachment.
Figure 2G:
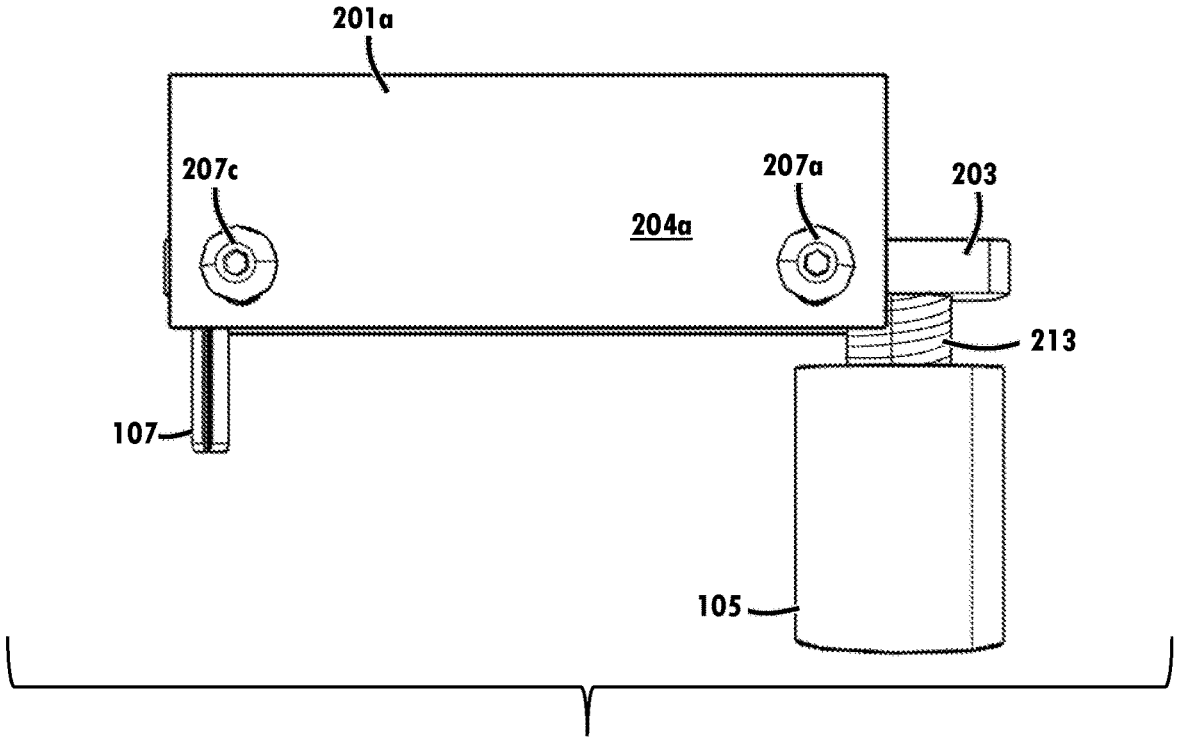
FIG. 2G is a second side view of an adjustable pry bar attachment.
Figure 2H:
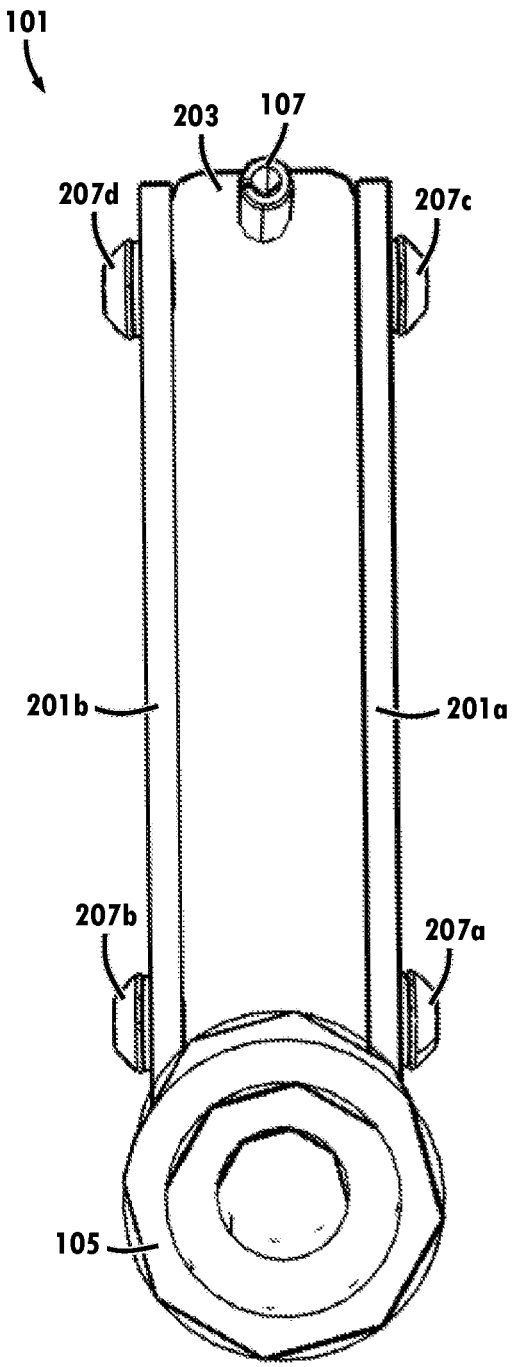
FIG. 2H is a bottom view of an adjustable pry bar attachment.
Figure 21:
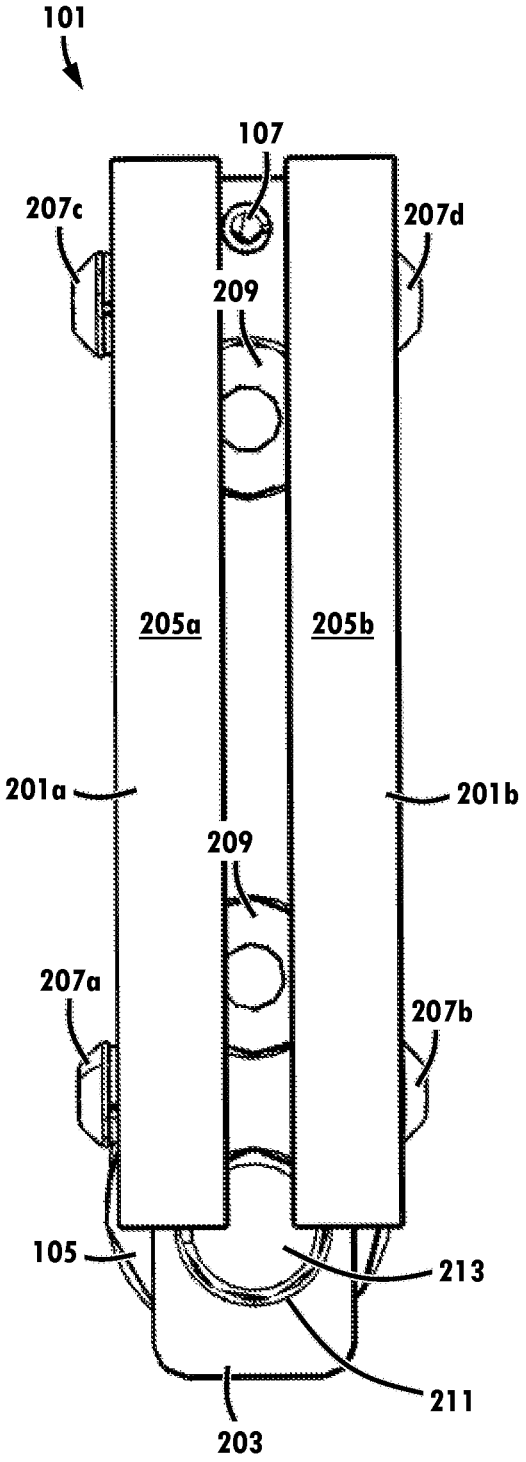

FIG. 1 illustrates a pry bar 100 having been received by a pry bar attachment 101. FIG. 1A provides an isometric view of pry bar 100 and pry bar attachment 101, and FIG. 1B provides a side view of the same arrangement of elements. Pry bar attachment 101 comprises a sleeve 103, operable to receive pry bar 100. Pry bar attachment 101 further comprises a fulcrum 105 operable to provide a pivot point during use of pry bar 100 to provide leverage. Fulcrum 105 may provide a focal point for applied leverage during use of pry bar 100. Pry bar attachment 101 may further comprise a friction lock 107 operable to prevent sleeve 103 from slipping along the longitudinal length of pry bar 100 during application of force. Friction lock 107 may advantageously also be used to provide a handle when a user does wish to adjust the position of pry bar attachment 101 with respect to the longitudinal length of pry bar 100. In this manner, pry bar attachment 101 may be an adjustable pry bar attachment. In some embodiments, pry bar attachment 101 may be removably coupled to a received pry bar 100 when friction lock 107 is not engaged. In the depicted embodiment, friction lock 107 is operably coupled to sleeve 103 via a screw-thread interface, but other embodiments may comprise other coupling mechanisms without deviating from the teachings disclosed herein. Additional details are discussed below with respect to additional drawings.

FIG. 2 illustrates pry bar attachment 101 from a number of different perspectives. FIG. 2A, FIG. 2B, FIG. 2C, and FIG. 2D show pry bar attachment 101 from different isometric perspectives. FIG. 2E shows an exploded view of pry bar attachment 101. FIG. 2F and FIG. 2G show pry bar attachment 101 from different side views. FIG. 2H shows pry bar attachment 101 from a bottom view. FIG. 2I shows pry bar attachment 101 from a top view. In the discussion below, references to FIG. 2 will correspond to one or more of these figures.

As depicted in FIG. 1, pry bar attachment 101 comprises a sleeve 103, a fulcrum 105 and a friction lock 107. In the depicted embodiment, sleeve 103 is comprised of multiple components, including a number of upright members 201 and a spine member 203. The number of upright members 201 may comprise a first upright member 201*a* and a second upright member 201*b*, which each comprise a projecting portion 204 and a retaining portion 205. First upright member 201*a* and second upright member 201*b* are functionally similar, and primarily are distinguished by their respective orientation with respect to spine member 203, which is disposed between them.

Sleeve 103 forms an interior portion operable to receive a pry bar (such as pry bar 100, see FIG. 1) using the interior surfaces of first upright member 201*a*, second upright member 201*b*, and spine member 203 when collectively assembled as shown in FIG. 2. The projecting portion 204 of each upright member extends away from spine member 203 in a direction substantially perpendicular to the interior surface of spine member 203. The substantially perpendicular extension is perpendicular to within a specified tolerance. The retaining portion 205 of each upright member extends away from the projecting portion 204 in a direction substantially perpendicular to its respective projecting portion 204 and substantially parallel to the interior surface of spine member 203. The substantially perpendicular extension is perpendicular to within a specified tolerance, and the substantially parallel extension is parallel to within a specified tolerance. In some embodiments, projecting portions 204 or retaining portion 205 may be adjustable in dimensions without deviating from the teachings disclosed herein. Adjustability of projection portions 204 or retaining portions 205 may advantageously permit pry bar attachment 101 to receive a variety of pry bars having a variety of dimensions or shapes.

The components of sleeve 103 may be operably coupled using a number of fasteners 207. In the depicted embodiment, fasteners 207 may comprise screws operable to couple upright members 201 to spine member 203, but other embodiments may comprise other fasteners without deviating from the teachings disclosed herein. In the depicted embodiment, fasteners 207 may comprise fastener 207*a*, fastener 207*b*, fastener 207*c*, and fastener 207*d*. In the depicted embodiment, all of fasteners 207 may be functionally similar, but are distinguished by their orientation and position with respect to sleeve 103. In the depicted embodiment, each of fasteners 207 may be operably interchangeable, but other embodiments may comprise a different configuration of fasteners without deviating from the teachings disclosed herein.

In the depicted embodiment, fasteners 207 may be adjustably coupled to sleeve 103 in such a way that they may adjust the distance between upright members 201. Adjustable-width features may advantageously permit pry bar attachment 101 to act as an adjustable pry bar attachment and receive pry bars of a variety of dimensions.

Pry bar attachment 101 may further comprise a number of elastic elements 209 may provide additional friction forces upon a received pry bar that prevent slippage during an application of force during use. In the depicted embodiment, elastic elements 209 may comprise a number of washers operably coupled to spine member 203, but other embodiments may comprise a rubber washer, rubber gripping pad, spring, screw or other elastic element suitable to increase friction forces and known to one of ordinary skill in the art without deviating from the teachings disclosed herein. In some embodiments, a plurality of elastic elements 209 may comprise distinct configurations without deviating from the teachings disclosed herein. In the depicted embodiment, elastic elements 209 operably couple to sleeve 103 using recessed portions of spine member 203, but other embodiments may comprise other configurations without deviating from the teachings disclosed herein. In some embodiments, the friction provided by elastic elements 209 may be adjusted, such as a screw mechanism within a threaded recess of spine member 203, but other embodiments may comprise other configurations without deviating from the teachings disclosed herein. In the depicted embodiment, elastic elements 209 may advantageously provide a specified friction force sufficient to retain a placement of pry bar attachment 101 when working in conjunction with friction lock 107, but not sufficient force to prevent manual adjustment of the placement when friction lock 107 is not engaged. In the depicted embodiment, elastic elements 209 may be operably coupled to spine member 203, but other embodiments may be operably coupled to other components of sleeve 103 without deviating from the teachings disclosed herein.

Fulcrum 105 is operably coupled to sleeve 103. In the depicted embodiment, this operably coupling may be accomplished using a threaded interface 211 of spine member 203, complemented by a threaded screw coupling 213 operable to interface with both fulcrum 105 and the threaded interface 211. In the depicted embodiment, threaded screw coupling is operable to couple to fulcrum 105 via a fulcrum screw thread 215, but other embodiments may comprise other coupling mechanisms without deviating from the teachings disclosed herein. In the depicted embodiment, threaded screw coupling 213 comprises a single threaded member having a uniform screw threading, but other embodiments may comprise other configurations without deviating from the teachings disclosed herein. In the depicted embodiment, fulcrum 105 is coupled to sleeve 103 using a threaded screw mechanism, meaning pry bar attachment 101 is an adjustable pry bar attachment that advantageously allows a user to adjust its relative height. Height adjustment of the pry bar attachment 101 permits the user to selectively configure the pry bar attachment for a preferred position during use of a received pry bar, advantageously improving versatility and ergonomics of the pry bar during use.

Figure 3:
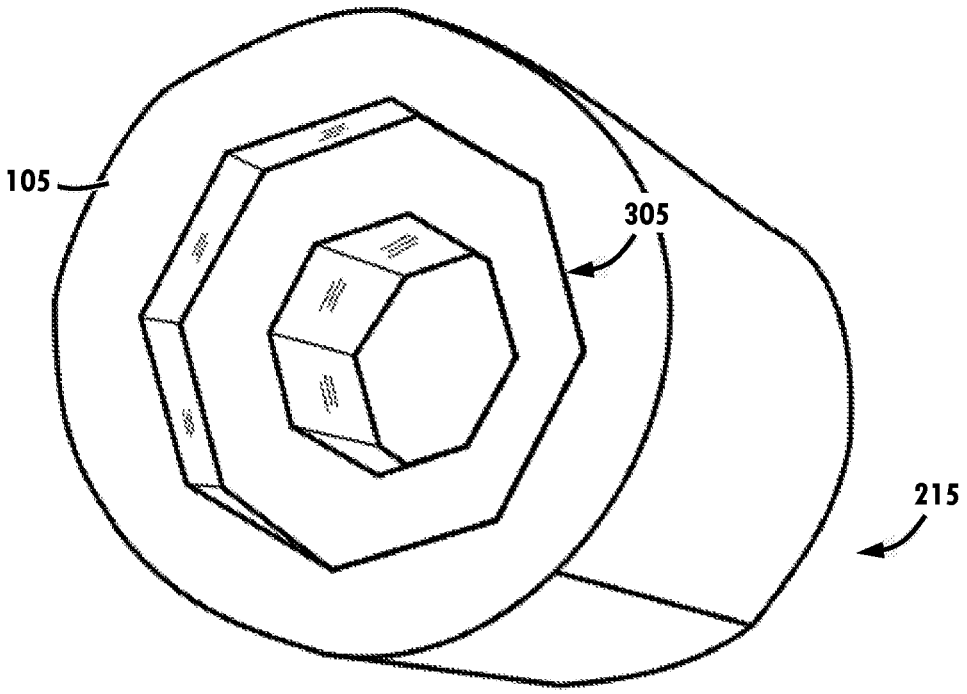
FIG. 3 is a close-up view of a concave mounting surface of a fulcrum of an adjustable pry bar attachment.

FIG. 3 is a close-up illustration of fulcrum 105 from a bottom-up perspective. In the depicted embodiment, fulcrum 105 comprises a bottom surface having a concave mounting surface 305. Concave mounting surface 305 may advantageously permit the fulcrum 105 to rest in a stable fashion on irregular or uneven surfaces, improving utility of pry bar attachment 101 on such surfaces. In the depicted embodiment, concave mounting surface 305 comprises a multi-tier cavity having an octagonal shape, but other embodiments may comprise other configurations without deviating from the teachings disclosed herein. Some embodiments may comprise single-tier cavities, or cavities having a different number of tiers without deviating from the teachings disclosed herein. Some embodiments may comprise non-polygonal cavities, smooth cavities, or irregular cavities without deviating from the teachings disclosed herein. Some embodiments may comprise multi-tiered cavities wherein different tiers comprise different shapes without deviating from the teachings disclosed herein. In the depicted embodiment, concave mounting surface 305 comprises a cavity that does not intersect with any cavity of fulcrum screw thread 215, but other embodiments may comprise other configurations without deviating from the teachings disclosed herein.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. An adjustable pry bar attachment, comprising:

a sleeve having a proximal end and a distal end opposite from the proximal end, the sleeve comprising an interior portion operable to receive a pry bar along a longitudinal axis of the pry bar.;

a fulcrum operably coupled to the sleeve nearer to the proximal end than the distal end; and an elastic element operably coupled to the sleeve and operable to impose a friction force upon a received pry bar, the friction varying according to a configuration of the elastic element, wherein the friction has a value sufficient to prevent motion of the sleeve along the longitudinal length of a received pry bar during an application of force to the pry bar at the fulcrum and wherein the fulcrum is operably coupled to the sleeve using a threaded screw coupling and the distance of the fulcrum from the sleeve may be adjusted using the threaded screw coupling.

2. The adjustable pry bar attachment of claim 1, wherein the fulcrum comprises a concave mounting surface.

3. The adjustable pry bar attachment of claim 1, wherein the sleeve comprises a first upright member, a second upright member, and a spine member disposed between the first upright member and the second upright member, the elastic element being operably coupled to the spine member.

4. The adjustable pry bar attachment of claim 3, wherein the distance between the first upright member and the second upright member is adjustable.

5. The adjustable pry bar attachment of claim 3, wherein the first upright member has a first projecting portion and a first retaining portion, the second upright member has a second projecting portion and a second retaining portion, wherein the first projecting portion and the second projecting portion are disposed on opposed sides of the spine, and wherein the first retaining portion and the second retaining portion are coplanar and spaced apart.

6. The adjustable pry bar attachment of claim 3, wherein the fulcrum is operably coupled to the spine member.

7. The adjustable pry bar attachment of claim 1, wherein the sleeve comprises an adjustable interior portion, the adjustable interior portion being operable to receive a variety of pry bars having different dimensions.

8. The adjustable pry bar attachment of claim 1, further comprising a friction lock operably coupled to the sleeve nearer to the distal end than the proximal end, the friction lock operable to restrict the motion of the sleeve along the longitudinal length of a received pry bar.

9. The adjustable pry bar attachment of claim 8, wherein the friction lock comprises a post operably coupled to the sleeve using a threaded interface.

* * * * *